United States Patent [19]

Mathias

[11] Patent Number: 4,712,782

[45] Date of Patent: Dec. 15, 1987

[54] METHOD AND APPARATUS OF SEPARATING AND TRANSPORTING FABRIC PIECES

[75] Inventor: Anthony D. Mathias, Toorak, Australia

[73] Assignee: Dunlop Olympic Limited, Victoria, Australia

[21] Appl. No.: 750,608

[22] PCT Filed: Sep. 7, 1984

[86] PCT No.: PCT/AU84/00169

§ 371 Date: May 7, 1985

§ 102(e) Date: May 7, 1985

[87] PCT Pub. No.: WO85/01037

PCT Pub. Date: Mar. 14, 1985

[30] Foreign Application Priority Data

Sep. 7, 1983 [AU] Australia ..... PG1303

[51] Int. Cl.[4] ..... B65H 3/06; B65H 3/44; B65H 5/00

[52] U.S. Cl. ..... 271/21; 271/105

[58] Field of Search ..... 271/9, 19, 20, 21, 22, 271/24, 25, 105, 106, 197, 95

[56] References Cited

U.S. PATENT DOCUMENTS

| | | | |
|---|---|---|---|
| 2,114,593 | 4/1938 | Donnellan | 271/106 |
| 3,127,167 | 3/1964 | Rabinow et al. | 271/197 |
| 3,477,558 | 12/1969 | Fleischauer | 271/197 |
| 3,583,695 | 6/1971 | Sherwood | 271/21 |
| 3,670,674 | 6/1972 | Conner, Jr. | 271/1 X |
| 3,712,611 | 1/1973 | Jacquot et al. | 271/95 |
| 3,806,114 | 4/1974 | Carter | 271/21 |
| 4,143,871 | 3/1979 | Blessing | 271/18.3 X |
| 4,223,884 | 9/1980 | Burnham et al. | 271/21 |
| 4,555,102 | 11/1985 | Engle | 271/18.3 X |

FOREIGN PATENT DOCUMENTS 2749908 5/1979 Fed. Rep. of Germany .

*Primary Examiner*—John W. Caldwell, Sr.
*Assistant Examiner*—Alvin Oberley
*Attorney, Agent, or Firm*—Fred Philpitt

[57] ABSTRACT

A method and apparatus for transferring single pieces from a stack (16) of limp fabric pieces to a receptor (25) for further processing wherein a drum (10) is brought into pressure contact with the top piece in said stack (16) and a marginal portion of that fabric piece is gripped by the drum (10) via a friction roller (20) carried by the drum. The drum (10) is then rolled over the stack (16) so the top fabric piece to be wrapped about the periphery of the drum (10). The drum (10) is then transported to an operative position above the receptor (20) and rolled thereover to lay the fabric piece flat on the receptor (25).

5 Claims, 4 Drawing Figures

METHOD AND APPARATUS OF SEPARATING AND TRANSPORTING FABRIC PIECES

This invention relates to a method and an apparatus for separating a fabric piece from a stack of such pieces and transferring the separated piece to a station for subsequent processing.

It will be appreciated that there are problems in the handling of fabric pieces in view of their limp nature, and the distortion or creasing which may occur as a result of non-uniform stressing of the piece of fabric.

However, with the increasing costs of manual labour there is a growing demand for mechanized handling of fabric pieces, particularly in the clothing trade, where high volume production of articles of standard size and shape is prevalent.

There have previously been proposed mechanisms for the separation and transfer of fabric pieces. However, these are relatively complex mechanisms usually designed for handling one particular shaped piece of fabric.

It is therefore an object of the present invention to provide a method and apparatus which is effective in the separation of a piece of fabric from a stack of such pieces, and transferring that separated fabric piece for subsequent processing. The apparatus should be of convenient, reliable and of simple construction.

There is provided in accordance with one aspect of the present invention a method of separating and transporting pieces of limp fabric from a stack of limp fabric pieces to a receptor comprises:

establishing contact between a margin portion of the top piece of said stack and a portion of a carrier member;

effecting relative movement between said portion of the carrier member and said stack, whereby portion of said top piece is separated from said stack and releasably gripped by the carrier member, effecting relative movement between the carrier member and the stack to remove said top piece from said stack so said top piece is supported by the carrier member in an extended condition.

transferring said carrier member with said top piece supported thereby from said stack to a receptor, effecting relative movement between said carrier member and said receptor to disengaging said top piece from the carrier member, releasing said marginal portion from the carrier member whereby said top piece is deposited in an extended condition on said receptor.

Conveniently, the carrier member has a part cylindrical surface, and the top piece of fabric is wrapped about said surface by rotating the carrier member about the axis of the cylindrical surface. Preferably there are perforations in said cylindrical surface and suction is applied to the fabric piece through the perforations to hold the fabric piece wrapped about the carrier member.

Also the fabric receptor may have a perforated surface through which suction is applied to the fabric piece to establish holding engagement therebetween. When the carrier member with the fabric piece wrapped thereabout is correctly located relative to the receptor, the suction applied to the fabric piece on the carrier member is reduced or terminated to release the fabric piece and the suction at the receptor takes over to hold the fabric piece to the receptor. The carrier member is rotated about the axis of the cylindrical surface to deposit the fabric piece onto the receptor.

Preferably the marginal portion of the fabric piece, releasably gripped by the carrier member, is adjacent one edge of the fabric piece and extends in the axial direction of the cylindrical surface of the carrier member. After this edge of the fabric piece has been gripped, the carrier member is rolled along the fabric piece by rotation about the axis of the cylindrical surface. When the marginal portion at the opposite edge of the fabric piece comes into engagement with the cylindrical surface, as a result of the rolling action, suction is applied to this opposite edge marginal portion to hold it to the cylindrical surface.

The carrier member, with the fabric piece attached thereto, is then moved to a position adjacent the receptor member, so that the opposite marginal portion is immediately adjacent the suction area of the receptor. The suction applied through the cylindrical surface is terminated, and suction applied through the receptor to now hold the opposite edge marginal portion onto the receptor. The carrier member is then rotated again but in the opposite direction to unwrap the fabric piece from the cylindrical surface of the carrier member and lay it in a flat condition on the receptor.

The movement of the carrier member, with the fabric piece attached, from the stack of fabric pieces to the receptor is conveniently effected by rolling the carrier member along a track, preferably rolling it on the axis of the cylindrical surface.

There is also provided in accordance with another aspect of the present invention apparatus for separating and transporting a piece of fabric from a stack of fabric pieces comprising:

a carrier member supported for movement between operative positions relative to the stack of fabric pieces and a fabric piece receptor, means to establish pressure contact between part of the carrier member and a marginal portion of the top fabric piece of the stack when the carrier member is in said operative position relative to the stack, means to effect movement of said part of the carrier member relative to the stack to separate said marginal portion of the fabric piece from the stack and releasably grip same by the carrier, means to move the carrier member relative to the stack after the marginal portion of the fabric piece is gripped thereby to wrap the remainder of the fabric piece about the carrier member, and transfer means to selectively move the carrier member between said respective operative positions.

Preferably, the receptor including means to receive in holding relation another portion of the fabric piece from the carrier member when the latter is in the operative position relative to the receptor whereby as the carrier member moves relative to the receptor the fabric piece is transferred from the carrier member to the receptor.

Conveniently, the carrier member moves alternately in opposite directions along a defined path, preferably straight, between the fabric piece stack and receptor, transferring one fabric piece during each cycle. Preferably the carrier member has a part cylindrical surface about which the fabric piece is wrapped. The carrier member may roll on the axis of said cylindrical surface to effect movement in each direction along said defined path. The carrier member may also roll on said axis to effect the wrapping of the top fabric piece of the stack about the carrier member and the transfer thereof to the receptor.

The method and apparatus of the present invention has the particular advantage that the fabric is wrapped about the carrier member as it is picked up from the fabric stack, and is maintained in this wrapped around condition whilst being transferred for delivery to the receptor. The fabric piece thus maintains its smoothed, uncreased and unstretched condition during pick up and transfer and comparatively large fabric pieces can be handled in this manner in the same beneficial way.

The invention will be more readily understood from the following description of one practical arrangement of the apparatus for handling limp fabric pieces as illustrated in the accompanying drawings.

Figures 2, 2A:
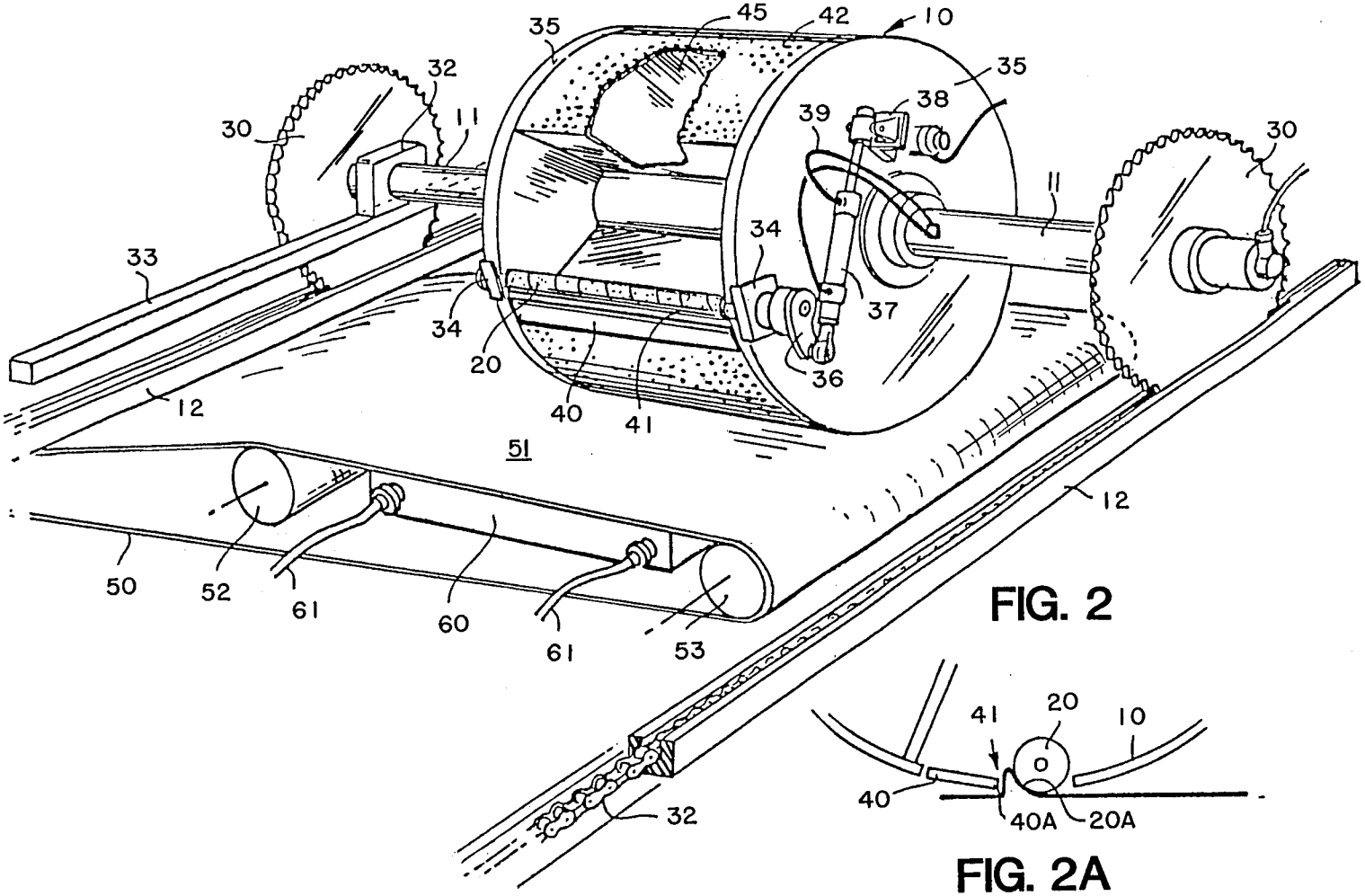
FIG. 2 is a perspective view partly schematic, of apparatus for use in the method of the present invention.

FIG. 2*a* is a detached large scale drawing of a partial section along line A—A in FIG. 2.

Figure 3:
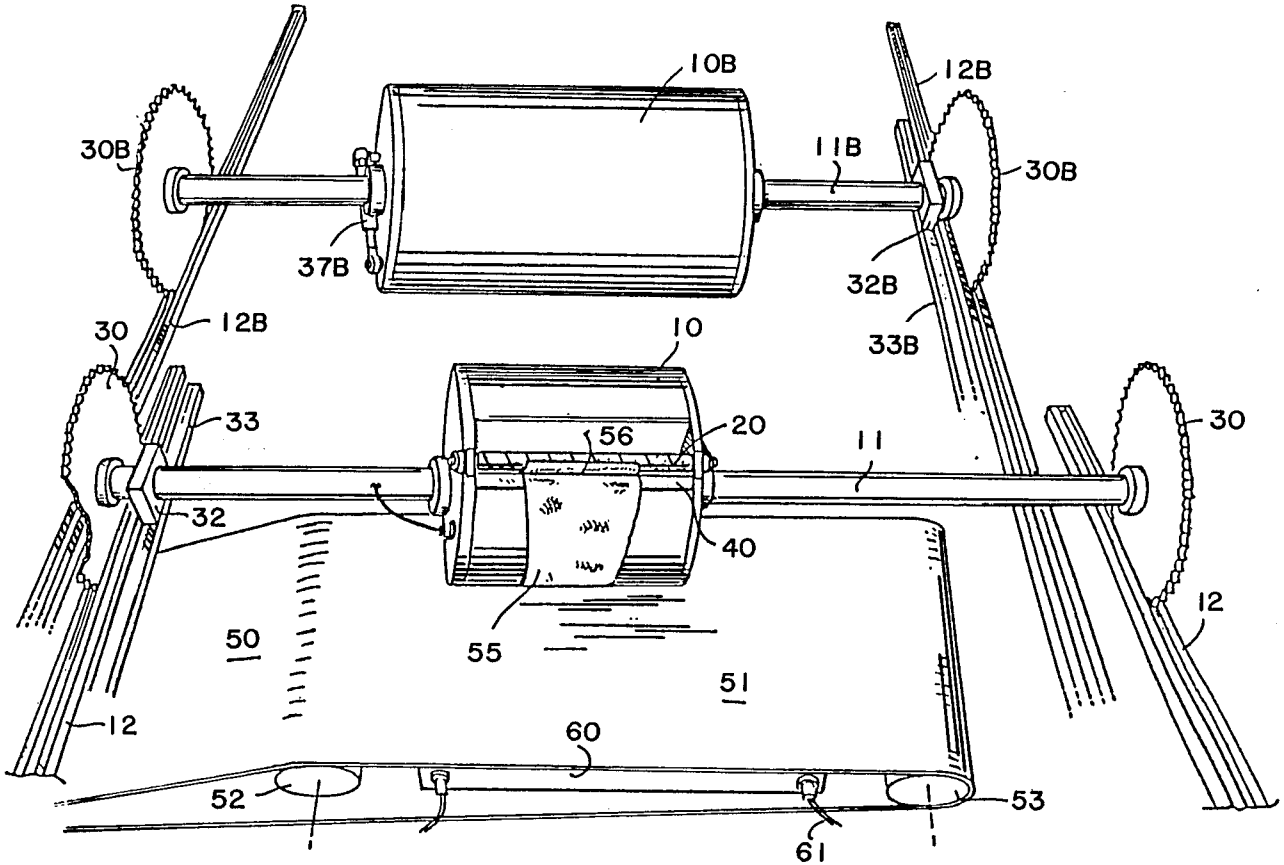

FIG. 3 is a view similar to FIG. 3 of apparatus for handling two pieces of limp fabric by the method of the present invention.

Figure 1:
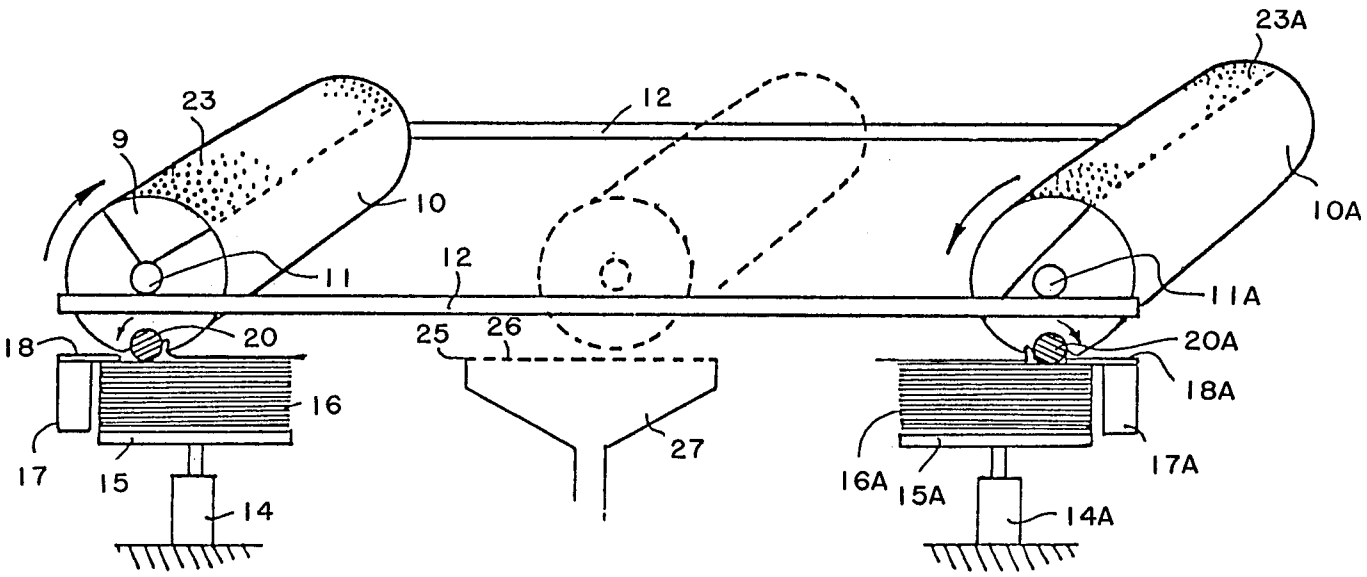
FIG. 1 is a diagram illustrating the essential steps of the method of handling limp fabric pieces.

Referring now to FIG. 1, the drum 10 has an external cylindrical surface and is rotatable on the co-axial shaft 11. The respective ends of the shaft 11 are supported on the laterally spaced rails 12 so that the drum 10 is suspended therebetween. Preferably, the shaft 11 and rails 12 have co-operating tooth formations thereon so that the rotation of the drum is positively related to movement of the drum along the rails.

A platform 15 is supported for raising and lowering movement relative to the rails 12 such as under the control of the fluid actuated cylinder 14. The platform 15 is for the purpose of supporting a stack of cut fabric pieces thereon such as indicated at 16. The platform 15 is located relative to the fixed stop member 17 against which the end of the stack 16 engage to provide a positive location for the fabric pieces in the longitudinal direction relative to the rails 12. The fixed blade 18 is provided to overlay the end of the stack of fabric pieces adjacent to the end stop member 17, so that as the platform 15 is raised the end portion of the top fabric piece in the stack will be pressed against the underface of the blade 18 by the operation of the cylinder 14.

The blade 18 is located a predetermined distance below the level of the rails 12 so that irrespective of the height of the stack of fabric pieces 16, the top piece of fabric in the stack will always be moved to the same position relative to the rails 12 each time the platform 15 is raised.

The drum 10 has rotatably supported therein a friction roller 20 so that the roller may rotate on its axis that is disposed parallel to the axis of the shaft 11. The diameter of the friction roller 12 and the position of its axis is arranged so that the surface of the roller protrudes slightly from the peripheral surface of the drum 10. Thus, as shown in FIG. 1 when the stack 16 of fabric is in the raised position, and the drum 10 is located with the friction roller 20 vertically below the axis of the drum, the surface of the friction roller 20 will be in pressure contact with the top fabric piece in the stack 16.

The peripheral surface of the drum 10 has over a sector thereof a series of perforations as indicted at 23 in FIG. 1. The arrangement of perforations extends for substantially the full axial length of the peripheral surface and conveniently extends over approximately 90° of arc. This perforated section 23 of the drum surface communicates with a chamber 9 within the drum which is connectable to a source of suction. It will thus be seen that by applying suction to this chamber 9 a layer of fabric positioned over the perforated section 23 of the drum surface would be held in position on the drum whilst so long as the suction was maintained within the chamber 9.

Spaced along the length of the rails 12 from the platform 15 is a fabric piece receptor 25 having a generally planar top surface 26 with a plurality of perforations therein. The perforated top surface 26 of the table receptor 25 communicates with the chamber 27 therebelow, which is also connectable to a source of suction so that a fabric piece disposed on the surface 26 will be held in position thereon when suction is applied to the chamber 27. The receptor 25 may form part of a machine intended to perform operations on the piece of fabric, or may be an intermediate component such as a conveyor upon which the fabric is initially positioned and prepared prior to being fed to a machine for operation thereon.

When the drum 10 is positioned as shown in FIG. 1 with the friction roller 20 protruding from the surface of the drum at the lowest point thereof, the platform 15 with the stack of fabric pieces 16 thereon is raised so that the top fabric piece in the stack is brought into pressure contact with the blade 18 and the friction roller 20. The friction roller 20 is then caused to partially rotate in an anti-clockwise direction as seen in FIG. 1. The rotational movement of the roller 20 will withdraw the front marginal portion of the top piece of fabric from beneath the blade 18 and cause it to form a fold as indicated at 19 on the opposite side of the roller 20.

That fold extends into a gap between the surface of the roller 20 and the longitudinal edge of the peripheral surface of the drum 10 immediately adjacent the friction roller 20. The width of this gap is selected, relative to the fabric being handled, so that when the folded fabric is forced into the gap by the friction roller 20 there is sufficient grip of the fabric to retain it in that position, while the remainder of the fabric piece is wrapped around the periphery of the drum 10.

Once the forward marginal portion of the fabric is held in position in the gap by the friction roller 20, then the drum 10 is rotated in a clockwise direction as viewed in FIG. 1, so that it will roll along the rails 12, at the same time, rolling over the surface of the top fabric piece in the stack 16. Since the forward marginal portion is gripped by the drum, this rolling of the drum will wrap the remainder of the fabric piece around the peripheral surface of the drum 10. The location of the perforated section of the surface of the drum relative to the roller 20, is such that as the top fabric piece is wrapped around the drum, at least the rear marginal end of the fabric piece will come into contact with the perforated section of the drum surface.

While the fabric piece is being wrapped about the drum, suction is applied to the chamber 9 within the drum 10, and thus the fabric piece s positively held in contact with the surface of the drum. Thus at least the two opposite ends of the fabric piece are firmly held on the drum, one end by the roller 20 and the other end by the perforated section of the drum surface.

Continued rolling movement of the drum along the rails 12 will bring the drum into a position above the receptor 25. The spacing between the platform 15 and the receptor 25 is such that, when the drum has rolled to an extent that the rear end of the fabric piece is at the lowermost point on the drum, then that end of the fabric piece is towards the right-hand end of the receptor 25 as viewed in FIG. 1 and as shown in broken outline. When so positioned the suction applied to the chamber 9 of the drum 10 is relieved, and suction applied to the chamber 27 in the receptor 25. In this way the rear end of the fabric piece is now drawn onto and held to the top surface 26 of the receptor 25. The drum 10 is now rolled in an anti-clockwise direction on the rails 12 as viewed in FIG. 1, so the fabric piece is progressively transferred from the peripheral surface of the drum onto the surface 26 of the receptor 25. When the extent of anti-clockwise movement of the drum has brought the folded portion of the fabric piece, which is gripped by the friction roller 20, adjacent to the surface 26 of the receptor, the continued movement of the drum 10 in the anti-clockwise direction will result in the folded fabric being withdrawn from the frictional grip of the roller 20, due to the force holding the fabric on the surface 26 being greater than the frictional force applied by the roller 20. Alternatively the roller 20 may be partially rotated in the clockwise direction, so as to withdraw the folded fabric from the gap and deposit it onto the surface 26 of the receptor in a flattened condition.

The drum will now continue to rotate in the anti-clockwise direction to return to the desired position above the stack 16 in preparation for picking up the next fabric piece which is now on the top of the stack 16.

It is to be noted as described above with reference to FIG. 1, the stack of fabric pieces 16, the drum 10 and associated components which operate to transfer fabric pieces from the stack 16 are located to the left of the receptor 25, and a similar stack of fabric pieces **16*a* and drum 10*a* are located to the right of the receptor 25. The stack 16*a*, drum 10*a*** and associate component are the same as described above and corresponding components are identified by the same reference numeral with the addition of the letter "a".

The drum **10*a* well pick up pieces of fabric from the stack 16*a* and deposit them on the receptor 25 in the same manner as described with reference to stack 16 and drum 10 except that the roller 20*a* and drum 10*a* will rotate in the opposite direction to the roller 20 and drum 10** during the various respective operations.

Each drum 10 and **10*a* may be used to deliver like pieces of fabric to the receptor 25 to increase the rate of delivery to the receptor. Alternatively, the stacks 16 and 16*a* may be of different pieces of fabric and may be deposited on the receptor 25 in a predetermined relative location. In one typical arrangement the drum 10 delivers fabric pieces intended to form the or part of a garment, and the drum 10*a* delivers a gusset for that garment or garment part. In this arrangement the piece of fabric forming the gusset is deposited on the piece of fabric forming the garment while the latter is in position on the receptor 25**.

Referring now to FIG. 2 of the drawing the drum 10 is non-rotatably mounted on the shaft 11 which at each end carries a chain wheel 30, also non-rotatably mounted. Each of the rails 12 are provided with a longitudinal groove in which the respective wheels 30 roll. A chain 32 is located in the base of each groove, with which the respective wheel 30 meshes, whereby slippage between the wheels 30 and the rails 12 is eliminated.

The block 32 is rotatably mounted on the shaft 11 and is connected to one end of the double acting fluid power cylinder 37. The other end of the power cylinder is anchored to the frame of the machine which also has the rails 12 fixed thereto. Thus, operation of the power cylinder 33 will effect movement of the chain wheels 30 along the rails 12 and also rotation of the drum 10.

The roller 20 is supported in bearings 34 mounted on the respective end plates 35 of the drum 10. At one end the roller 20 carries an arm 36 non-rotatably attached thereto. The double acting fluid power cylinder 37 is connected at one end to the arm 36 and at the other end to the bracket 38 fixed to the end plate 35. Operation of the power cylinder 37 effects partial rotation of the roller 20 about its axes which is parallel to the axes of the shaft 11 and drum 10. Fluid to operate the cylinder 37 is supplied through the respective conduits 39 which pass through a cavity in the shaft 11.

Desposed parallel to the roller 20 and secured to the drum 10 is a ledger plate 40. The edge of the ledge plate is spaced from the roller 20 to define a gap 41 as shown in more detail in FIG. **2*a*. The gap 41 has opposite parallel edges 20*a* and 40*a* spaced apart a distance so the fold of fabric, drawn thereinto by the rotation of the roller 20, is gripped between the ledger plate and the roller. The roller 20 has friction material on the surface thereof to prevent slippage between the roller and the top piece of fabric on the stack 16, when the roller is rotated while in contact with stack 16. The friction material also promotes the grip of the folded piece of fabric that is drawn into the gap 41**.

The peripherial wall 42 of the drum between the end plates 35 is of cylindrical form but is not a full circle. The radial walls 43 extend from the respective edges of the peripheral wall to the shaft 11 to define within the roller the chamber 45. The peripheral wall 42 has a series of perforations therein the distribution and size of the perforations is selected according to the shape oif the piece of fabric to be transported and the nature of the fabric. The chamber 45 may be selectively subjected to vacuum in order to hold the fabric piece wrapped about the peripheral wall during movement of the drum from the location where the fabric is taken from the stack 16, to the location where the fabric is deposited on the receptor 25.

The receptor 25 as shown in FIGS. 2 and 3 is a conveyor belt 50 having a portion 51 of the top flight, supported by the roller 52 and 53, that is flat and parallel to and between the rails 12 upon which the drum 10 is supported. This flat portion 59 of the belt is located in the path of the drum 10, as the chain wheels 30 moves along the rails 12, whereby the drum may be positioned above the flat portion 51 of the belt and transfer the fabric piece from the drum to the belt.

Beneath the flat portion 51 of the belt is located a box 60, the top of which is open, and is connectable at 61 to a vacuum source. The belt is of an air permiable material, and the belt is in contact with the upper perimential edge of the box 60. When the box 60 is in communication with the vacuum source the belt will seal against the perimetial edge of the box, and a piece of fabric located on the belt will be held thereon by the action of the vacuum.

Subject to various factors including the size of the fabric piece, the nature of the fabric, and the surface characteristics of the drum and belt surface, it is possible in some instances to transfer the fabric piece from the drum to the belt without the use of the vacuum box 60.

In such instances the removal of the vacuum from the chamber 45 and the rolling of the drum over the flat portion 51 of the belt will lay the fabric piece in a flat condition on the belt. It may in some circumstances be desirable to pressurize the chamber 45 so an outward flow is established through the drum perforation to assist in the transfer of the fabric piece to the belt.

As previously described with reference to FIG. 1 of the drawings two drums may be used to transfer fabric pieces from respective stacks to a single receptor such as the conveyor belt 50. FIG. 3 of the drawings show such an arrangement in greater detail employing two drums of the same construction as shown in FIG. 2. In FIG. 3 the forward drum assembly corresponds to the drum assembly shown in FIG. 2 and corresponding components carry the same reference numerals. The other or rearward drum assembly in FIG. 3 is of the same construction previously described with reference to FIG. 2 and corresponding component carry the same reference numeral with the addition of the letter "b".

In FIG. 3 the drum 10 is carrying a fabric piece 55 with the portion 56 gripped between the roller 20 and the ledger plate 40. The other end of the fabric piece is below the drum is contact with the surface of the flat portion 51 of the conveyor belt 50. As the drum 10 is rolled forward from the position shown the fabric piece 55 is laid onto the belt. During the final stage of the rotational movement to roller 20 is rotated in a direction to release the portion 56 of the fabric piece from the gap between the roller and ledger plate.

The two drum arrangement shown in FIG. 3 is particularly suitable for delivering two pieces of fabric to the conveyor belt 50 in sequence with one piece being deposited on top of the other in a selected relationship.

The movement of the drum or drums (10), actuation of the roller or rollers (20) and the application of vacuum to the cylinder chamber and receptor box, are sequence controlled by various sensors that respond to the relevant component reaching a selected location. The fluid pressure operated cylinders referred to in the specification are preferably air operated and suitable valving is provided to activate the cylinders in accordance with the required sequence of operations.

The claims defining the invention are claimed as follows:

1. An apparatus for separating a piece of limp fabric from a stack of fabric pieces and transporting said piece to a distant receptor location comprising in combination (A) a carrier member having a generally cylindrical outer surface, (B) means for moving said carrier member by rotation from a position adjacent said stack of fabric pieces to a position adjacent said receptor location, (C) means to establish pressure contact between said stack of fabric pieces and the periphery of said carrier member, (D) means to rotate the carrier member relative to said stack of fabric pieces to thereby separate one piece of limp fabric from the top of said stack, the improvement which comprises (1) said generally cylindrical carrier member having an elongated opening in its external surface which is parallel to the axis of the carrier member, (2) said generally cylindrical carrier member being provided with an elongated friction roller that is positioned in said elongated opening so that a portion of the outer periphery of said friction roller extends outwardly beyond the outer circumference of said generally cylindrical carrier member and so that an elongated gap is left between said elongated opening in said carrier member and said elongated friction roller, the axis of said carrier member and the axis of said friction roller being in fixed positions relative to each other, (3) means to rotate said elongated friction roller in a direction opposite to the direction of rotation of said carrier member so that rotational movement of the elongated friction roller over the top of said stack will withdraw the front marginal portion of the top piece of fabric in the stack and both cause it to form a fold and then force this fold into said elongated gap, (4) the width of said elongated gap that is adjacent said elongated friction roller being selected relative to the fabric being handled so that when the fold formed by rotating said elongated friction roller is forced into said elongated gap the elongated gap will exert a sufficient gripping force on the fold to retain the fold in that position in the elongated gap, and (5) suction means associated with a portion of the external surface of said carrier means which insures that the remainder of the fabric piece that is not held in said elongated gap will be retained against the exterior surface of the generally cylindrical carrier means.

2. A method for separating a piece of limp fabric from a stack of fabric pieces and transporting said piece to a distant receptor location comprising (A) establishing contact between a marginal portion of the top piece of fabric in said stack and a portion of a carrier member having a generally cylindrical outer surface so that the carrier member will grip said marginal portion, (B) moving said carrier by rotation relative to said stack so that said top piece of fabric will be moved away from said stack to a receptor, (C) effecting relative movement between said carrier member and said receptor to thereby disengage said piece of fabric from said carrier member, whereby said piece of fabric is deposited in an extended position on said receptor, the improvement comprising (1) providing an elongated opening in the external surface of said carrier member, which opening is parallel to the axis of the carrier member, (2) providing an elongated friction roller within said elongated opening so that a portion of the outer periphery of said friction roller extends outwardly beyond the outer circumference of said carrier member and so that an elongated gap is left between said elongated opening in said carrier member and said friction roller, the axis of said carrier member and the axis of said friction roller being in fixed positions relative to each other, (3) rotating said friction roller in a direction opposite to the direction of rotation of said carrier member so that rotational movement of the elongated friction roller over the top of said stack will withdraw the front marginal portion of the top piece of fabric in the stack and both cause it to form a fold and then force this fold into said elongated gap so as to be firmly retained therein, and (4) utilizing suction to retain the remainder of the fabric piece pressed against the exterior surface of the carrier means.

3. Apparatus as set forth in claim 1 wherein the receptor includes (a) means to hold at least part of the fabric piece in contact with the receptor as it is being transferred thereto, and (b) vacuum means.

4. A method as set forth in claim 2 wherein a top piece of fabric from each of two stacks is transported in sequence to the receptor and deposited thereon in a predetermined relation, and wherein one piece of fabric is deposited in a superimposed relation on the other.

5. A method as set forth in claim 4 wherein said top piece is deposited in an extended condition on said receptor by applying a vacuum underneath a perforated surface constituting said receptor.

* * * * *